US009156224B2

(12) United States Patent
Pease

(10) Patent No.: US 9,156,224 B2
(45) Date of Patent: Oct. 13, 2015

(54) PLASTIC BAG, METHODS FOR MAKING BAGS AND IMPROVED POUCH MACHINE

(75) Inventor: James F. Pease, Lake in the Hills, IL (US)

(73) Assignee: KV-LOCK LLC, Miami, FL (US)

( * ) Notice: Subject to any disclaimer, the term of this patent is extended or adjusted under 35 U.S.C. 154(b) by 761 days.

(21) Appl. No.: 13/515,526

(22) PCT Filed: Dec. 14, 2010

(86) PCT No.: PCT/US2010/060260

§ 371 (c)(1), (2), (4) Date: Jun. 13, 2012

(87) PCT Pub. No.: WO2011/081923

PCT Pub. Date: Jul. 7, 2011

(65) Prior Publication Data

US 2012/0270712 A1 Oct. 25, 2012

Related U.S. Application Data

(63) Continuation-in-part of application No. PCT/US2010/054008, filed on Oct. 26, 2010.

(60) Provisional application No. 61/286,069, filed on Dec. 14, 2009.

(51) Int. Cl.
*B31B 1/90* (2006.01)
*B31B 19/90* (2006.01)
(Continued)

(52) U.S. Cl.
CPC ..... *B31B 1/90* (2013.01); *A44B 18/0046* (2013.01); *B26D 3/08* (2013.01); *B31B 19/90* (2013.01);
(Continued)

(58) Field of Classification Search
None
See application file for complete search history.

(56) References Cited

U.S. PATENT DOCUMENTS 4,261,253 A * 4/1981 Smith, II ..... 493/189
4,953,708 A 9/1990 Beer et al.
(Continued)

FOREIGN PATENT DOCUMENTS

CA 2348034 5/2000
JP 2002-529169 A 9/2002
(Continued)

OTHER PUBLICATIONS

International Search Report dated Jul. 25, 2011 for PCT/US10/54008.
(Continued)

*Primary Examiner* — Christopher Harmon
(74) *Attorney, Agent, or Firm* — Fleit Gibson Gutman Bongini & Bianco PL; Martin Fleit; Paul D. Bianco

(57) ABSTRACT

Method and apparatus for making a plastic bag or pouch wherein a plastic web is moved in a longitudinal direction and a tape made from an elongated plastic film is fed to the web. The tape is made of a pair of elongated attachment lanes of complementary fastening elements sealed to the film to function as attachable-detachable closures. The lanes extend parallel and are spaced apart. A perforation line is formed in the film between lanes, and a flange is defined on one side of only one of said lanes. The lanes are separated and pairs of lengths are cut off said lanes. The pairs of cut off lengths are sealed on a diagonal to the moving web in different directions to form V-shaped closures with the lane having the flange on one side thereof sealed to the web by the flange only. Bags are formed from the moving web. An intermediate product is described consisting of a narrow substrate having V-shaped closures spaced longitudinally for placement on a moving web in a bag making machine.

16 Claims, 13 Drawing Sheets

(51) Int. Cl.
*A44B 18/00* (2006.01)
*B26D 3/08* (2006.01)

(52) U.S. Cl.
CPC . *B31B 2219/6092* (2013.01); *B31B 2219/9016* (2013.01); *B31B 2237/50* (2013.01); *Y10T 83/0481* (2015.04); *Y10T 428/15* (2015.01)

(56) References Cited

U.S. PATENT DOCUMENTS

| | | | | |
|---|---|---|---|---|
| 5,172,980 | A | 12/1992 | Provost | |
| 6,164,826 | A * | 12/2000 | Petkovsek | 383/210.1 |
| 6,202,260 | B1 | 3/2001 | Clune et al. | |
| 6,481,183 | B1 | 11/2002 | Schmidt | |
| 6,656,403 | B1 | 12/2003 | Clune et al. | |
| 6,871,473 | B1 | 3/2005 | Dutt et al. | |
| 6,986,237 | B2 | 1/2006 | Ausnit et al. | |
| 6,991,375 | B2 | 1/2006 | Clune et al. | |
| 7,093,409 | B2 | 8/2006 | Dutt et al. | |
| 7,163,706 | B2 | 1/2007 | Shepard et al. | |
| 7,308,783 | B2 | 12/2007 | Shepard et al. | |
| 7,406,810 | B2 * | 8/2008 | Clune et al. | 53/412 |
| 7,424,796 | B2 | 9/2008 | Shepard et al. | |
| 7,597,657 | B2 * | 10/2009 | Yeager | 493/213 |
| 8,051,540 | B2 | 11/2011 | Gallant et al. | |
| 8,641,279 | B2 * | 2/2014 | Ichikawa et al. | 383/65 |
| 8,727,621 | B2 * | 5/2014 | Owensby et al. | 383/204 |
| 8,900,109 | B2 * | 12/2014 | Pease | 493/212 |
| 2003/0031386 | A1 | 2/2003 | Shepard et al. | |
| 2003/0142888 | A1 | 7/2003 | Provost et al. | |
| 2003/0228078 | A1 | 12/2003 | Clune et al. | |
| 2004/0008909 | A1 | 1/2004 | Shepard et al. | |
| 2004/0131731 | A1 | 7/2004 | Shepard et al. | |
| 2005/0086911 | A1 | 4/2005 | Dutt et al. | |
| 2006/0062496 | A1 | 3/2006 | Clune et al. | |
| 2006/0162289 | A1 | 7/2006 | Shepard et al. | |
| 2008/0041022 | A1 | 2/2008 | Shepard et al. | |
| 2008/0131035 | A1 | 6/2008 | Rogers | |
| 2009/0013644 | A1 | 1/2009 | Yeager | |
| 2010/0144507 | A1 * | 6/2010 | Yeager | 493/212 |
| 2011/0116730 | A1 | 5/2011 | Kawakami et al. | |
| 2012/0035036 | A1 | 2/2012 | Pease | |

FOREIGN PATENT DOCUMENTS

| | | | |
|---|---|---|---|
| JP | 2004-505807 | A | 2/2004 |
| JP | 2005-206162 | A | 8/2005 |
| JP | 2009-046156 | A | 3/2009 |
| WO | 2011/081703 | | 7/2011 |
| WO | 2011/081923 | | 7/2011 |

OTHER PUBLICATIONS

Written Opinion for PCT/US10/54008 dated Jul. 21, 2011.
Restriction requirement for U.S. Appl. No. 13/178,194 dated May 7, 2014.
Response to restriction requirement for U.S. Appl. No. 13/178,194 dated Jun. 9, 2014.
Office Action dated Jul. 3, 2014 for U.S. Appl. No. 13/178,194.
International Preliminary Report on Patentability published Jun. 19, 2012 for PCT/US2010/060260.
International Preliminary Report on Patentability for PCT/US10/54008 published Jun. 19, 2012.
International Search Report published Nov. 17, 2011 Jun. 19, 2012 for PCT/US2010/060260.
International Search Report for PCT/US10/54008 published Sep. 15, 2011.
Notice of Allowance dated Aug. 11, 2014 for U.S. Appl. No. 13/178,194.

* cited by examiner

PLASTIC BAG, METHODS FOR MAKING BAGS AND IMPROVED POUCH MACHINE

BACKGROUND OF THE INVENTION

1. Field of Invention

The present invention relates to a plastic bag or pouch having a novel closure, and to methods for making the plastic bag. More particularly, the invention relates to a pouch machine for making plastic pouches including an improvement for a novel reusable pour closure in the pouch.

2. Prior Art

Pouch making machines and methods are known for making plastic bags or pouches. Fitting a plastic bag or pouch with a reusable fastener is also known. However, there still exists a need for a plastic pouch having a closure that comprises advantages over known bag closures.

SUMMARY OF THE INVENTION

Accordingly, it is a principal object of the present invention to provide an open mouth plastic bag or pouch having a novel reusable closure for opening and closing the bag or pouch that will provide advantages in use. This is accomplished by providing a novel intermediate product that enables closures to be mounted and sealed effectively in the open mouth of plastic pouches or elsewhere on the plastic pouches as they are being made. To this end, a conventional bag or pouch making machine is modified to facilitate the positional sealing of novel closures or fasteners. A principal advantage of the invention is to be able to produce novel bags or pouches having a unique effective, efficient and economical closure by a simple modification of an existing bag or pouch machine. A further advantage is to provide a unique sealed closure of the pouch having greater mechanical strength in one direction than another.

In addition to the foregoing, the present invention relates to a bag closure for example, for a pet food plastic bag or pouch, that has a side gusset. The bag is provided with a novel hook-to-hook Velcro® closure on a preselected percentage of the top opening of the bag or pouch including at least one gusset. The design can be used as a full Velcro® closure to encapsulate all the distance around the interior of the bag top or limited to the area including at least one gusset needed to pour. A unique advantage of the invention is that it can close the gusset onto its four layers for the bag to maintain its original shape, or one can pour from the pouch by reversing the gusset, puffing it out, to two layers, and then closing the gusset together and sealing the pouch. Velcro® is a registered trademark of Velcro Industries B.V. LTD.

Further the invention includes the formation of hook-to-hook dual application/dual direction V-shaped Velcro® closures at any location on a bag and even at multiple locations on a bag or series of bags, but particularly at the top of one gusset on one top corner of a bag. In this way, a very convenient pour spout is formed that can be accessed by removing an outer triangular section of the corner to render the closure or fastener accessible for opening and closing. As noted above, the gusset can be closed onto its four layers for the bag to maintain its original shape, or one can pour from the pouch by reversing the gusset, pulling it out, to two layers, and when finished pouring then closing the gusset together and sealing the pouch.

In a still further advance, the invention includes novel apparatus to be combined with a bag making machine for putting of hook-to-hook diagonal gusset V Velcro® closures at any location on a bag Other objects and advantages of the present invention will become apparent to those persons skilled in this art from the following detailed description of preferred embodiments of the invention when taken in conjunction with the appended drawings.

DETAILED DESCRIPTION OF PREFERRED EMBODIMENTS OF THE PRESENT INVENTION

Figure 1:
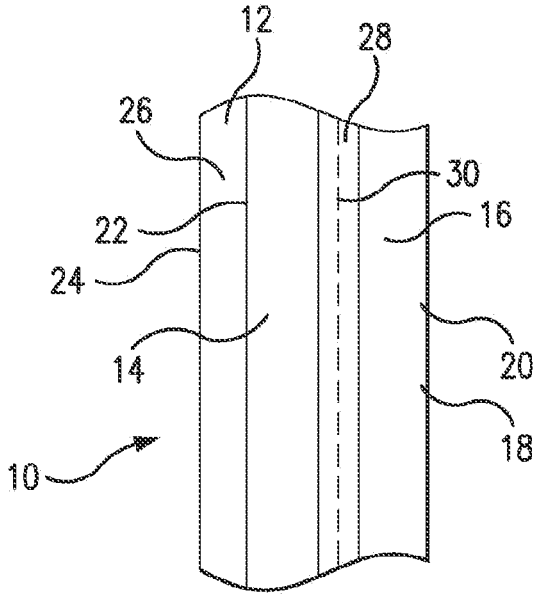
FIG. 1 shows schematically in plan the novel intermediate product of the present invention.

Referring to FIG. 1 the novel intermediate product used to form a closure for an open mouth plastic bag or pouch is schematically shown in plan. The product is an endless tape, or strip or ribbon that can be wound on a bobbin or roll for convenience. The tape 10 is composed of a substrate or base film 12 of a polyolefin or blend of polyolefin. However, any heat sealable material can be used. Base film or substrate 12 is from about 1 mil to about 8 mils thick, with 5 mils being preferred. Sealed onto base film 12 by any known means are two lanes 14 and 16 that coact together and mate to engage and form a fastener. Suitable materials for this purpose would be commercial strips sold by Velcro USA Inc. under the trademark Velcro®. A typical example is one lane been of a hook construction and the other lane being of a loop construction, as well known in the art, so that when pressed together they form a fastener/closure that can be opened by pulling apart. In FIG. 1, the two lanes 14 and 16 are comprised of Velcro® bidirectional hook lanes as the preferred choice. The lanes 14 and 16 extend parallel and are from about ¼" to about 1" wide, with 318" being preferred and are spaced apart by web portion 28 of film 12 having a width of from about ⅛" to about ½", with ¼" being preferred. The space or substrate portion 28 between the two lanes 14 and 16 constitutes a fold area and is comprised of that portion of film lying between the two lanes. As will be apparent from FIG. 1, lane 16 is co-terminal with edge 18 of film 12 on its side 20 remote from lane 14. Lane 14 on its side 22 remote from lane 16 terminates spaced from edge 24 of film or substrate 12. The substrate or space portion from lane 14 to edge 24 is comprised of base film 12 and constitutes a flange 26 that is from about ⅕" wide to about 1" wide, with ¼" wide being preferred. The dimensions noted above are for commercially make plastic bags or pouches most frequently being made presently. The invention is not restricted to the above dimensions and would be revised according to the size of bag or pouch being made.

Whereas any form of such type of Velcro® fastener can be used, including hook-loop, hook-hook, and other designs sold by Velcro USA Inc., the hook-to-hook is preferred. Also, similar fasteners made by others can be used, such as a known mushroom head style, or an arrowhead style as conceived by the inventor hereof. What is important is that the closure be comprised of two parts that coact, engage releasably and mate when pressed together (compressed) to close and seal an opening, but can be subjected to a preselected tension force to uncouple or unmate and re-open and unseal the opening in the pouch for either material to be removed from the pouch or bag or material to be filled into the bag of pouch or bag.

The substrate portion or space 28 between the two lanes 14 and 16 defines a perforation line 30 exactly midway between the two lanes. Perforation line 30 consists of a series of lands interspaced between through cuts. The perforation line 30 ranges from about 50% cut/50% land to about 90% cut/10% land, with about 70% cut/30% land being preferred. The perforation line enables easy and effective folding over and mating of the lanes 14 and 16 during the procedure for making bags or pouches so that the lanes register exactly and are either fully engaged or mated or engaged or mated sufficiently so that further processing to make the bags or pouches does not affect the mating, alignment or registry of the lanes. Perforation line 30 constitutes the fold plane of the folding over. By means of the perforation line 30 as described the making of bags or pouches proceeds in an exceedingly easy and effective way.

Figure 2A:
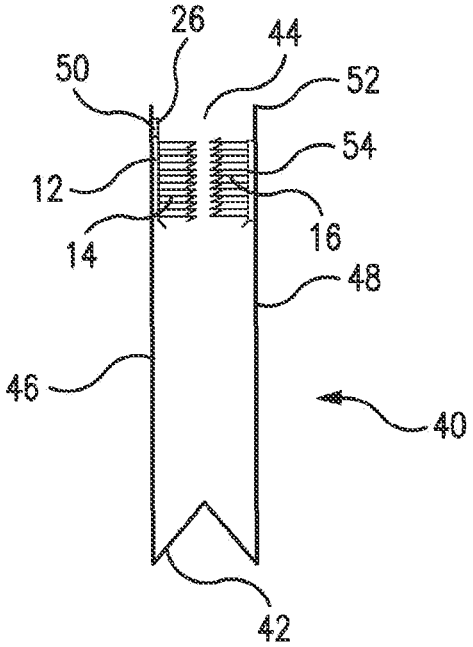
FIG. 2*a* is a section through a plastic pouch or bag showing how the product shown in FIG. 1 is positionally mounted and sealed in an open mouth of the plastic bag or pouch to function in a unique way as a reusable closure; the bag or pouch is shown open.

Referring now to FIG. 2*a*, illustrated in a sectional view through an open finished bag or plastic pouch 40 that shows how the intermediate product described with reference to FIG. 1 (tape 10) is mounted in the open mouth of plastic bag or pouch 40 to function as a reusable closure. As shown, the plastic bag or pouch 40 (hereinafter pouch) has a gusset 42 formed in its bottom so that it can stand up. The pouch 40 with its open top or mouth 44 has two sides 46 and 48. The underside 50 of the substrate or film 12 beneath the flange area 26 is sealed to the inside of the pouch 40 on side 46 spaced slightly down (from about ¼" to about 1') from the top edge 52 of pouch 40. The underside 54 of the substrate or film 12 beneath lane 16 is sealed to the inside of side 48 of pouch 40. The portion of tape 10 that constitutes and underlies lane 14 is not sealed to the interior of the pouch 40 and forms and enables a hinging effect relative to unsealed lane 14. Flange 26 may be sealed for its whole width to the inside of pouch 40 or only sealed for part of its width as shown in FIG. 2*a*.

When the folded tape 10 is mounted and sealed to webs or films 60 and 62 from which pouches are being formed, the perforation line 30 in web 28 is cut to separate or uncouple the lanes 14 and 16 so that thereafter the lanes only couple when engaged face-to-face and are subjected to a compressive force to cause engagement or mating. Although the sealing of the undersides of film 12, as noted, preferably take place by is heat sealing, any known way of effecting attachment can be employed.

Figure 2B:
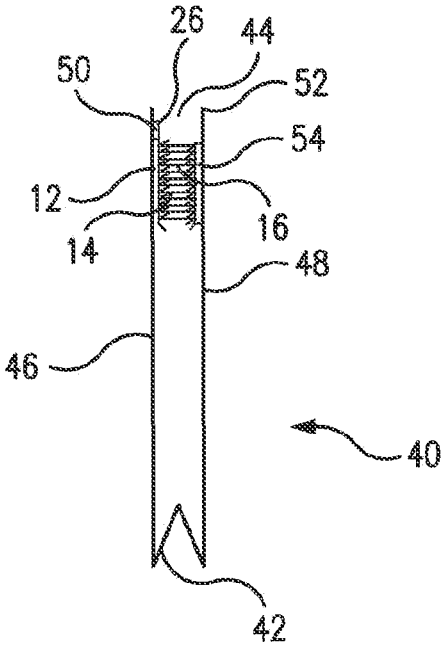
FIG. 2*b* is a section through a plastic bag or pouch, as in FIG. 2*a*, showing the pouch closed and sealed.

FIG. 2*b* shows the pouch 40 with the closure sealed by lanes 14 and 16 being compressed together to engage fully. At this time, any contents in the pouch 40, due to the hinge effect of the lane 14 not being sealed to side 46, will result in tension forces exerted upon the closure of the pouch 40 being greatly reduced with respect to shear forces being exerted upon the closure. This will greatly improve the capability of the closure to withstand forces that would tend to open the sealed closure. Referring now to FIGS. 3, 3*a*, 3*b* and 3*c*, the process for making bags or pouches according to the present invention is shown schematically. As shown, top and bottom continuous webs or films 60 and 62 of suitable plastic material, such as polyolefin, are fed from supply rolls 65 mounted on machine frame 61, noted generally. The films feed via known control and powered rolls (omitted for simplicity), also mounted on the frame 61, so that the top web 60 eventually runs in parallel over the bottom web 62, but is spaced therefrom vertically. A continuous supply of tape 10 is unwound from a supply roll, also mounted on the frame 61, and is fed via dancer control rolls, in a known manner; to a folder 68 situated within the profile of the two webs 60 and 62 adjacent one side thereof, and just before the two webs 60 and 62 are brought together. Tape 10 is fed to the folder 68 with the flange 26 inboard (remote from the adjacent web edge). As tape 10 passes through the folder 68, the flange 26 and hook lane 14 are folded over the hook lane 16 about the perforated line 30 so that the hook lanes 14 and 16 engage in registry exactly and are compressed together during passage through the folder 68 to form a closed fastener generally indicated by reference numeral 85 with the flange 26 now extending outboard (adjacent to) toward adjacent edge 70 of web 60, see FIG. 3*a*. This action is initiated by manually folding over tape 10 in the manner described and leading or threading the initial folded over portion through the folder 68. Thereafter, since tape 10 is fed continuous and being pulled downstream of the folder 68, the folding action about the perforation line 30 will automatically continue as tape 10 is pulled through the folder 68, as will be described in more detail below. The folded tape 10 is positioned so that the flange 26 is spaced a short distance laterally or inboard (from about ¼" to about 1") from adjacent edge 70 of the top web 60. As the tape 10 is folded, the bottom surface of the substrate film 12 beneath flange 26 and lane 14 will be exposed upwardly. Only the portion of the exposed bottom surface of substrate beneath the flange 26 is sealed (heat welded or by adhesive) to the under surface of the lop running web 60, see FIG. 3*b*, by means of a presealing unit 73 of designed as a slit seal bar for the flange 26 to hinge after sealing to the top web 60 and to lock the tape 10 in position relative to the webs 60 and 62. The sealed flange 26 acts as a hinge. Next the two webs 60 and 62 are brought together and edges remote from tape 10 are longitudinally sealed at 74 by known means to seal the area that will become the pouch bottoms. The web edges adjacent the tape 10 pass top and bottom sealing devices 76, 78. Device 78 comprises a bottom seal bar to seal correctly the underside of film 12 that lies beneath lane 16 to the top surface of bottom web 62 as shown in FIG. 3*c*. The top device 76 is comprised of a specially designed seal bar 81 for heat and a chilled silicone element 83 to insure that the region covered by the chilled silicone rubber is not sealed, namely, the area including the substrate underlying lane 14 and a small portion of the flange 26. The portion of the substrate to which lane 14 is sealed remains unsealed to the top web.

Figure 3:
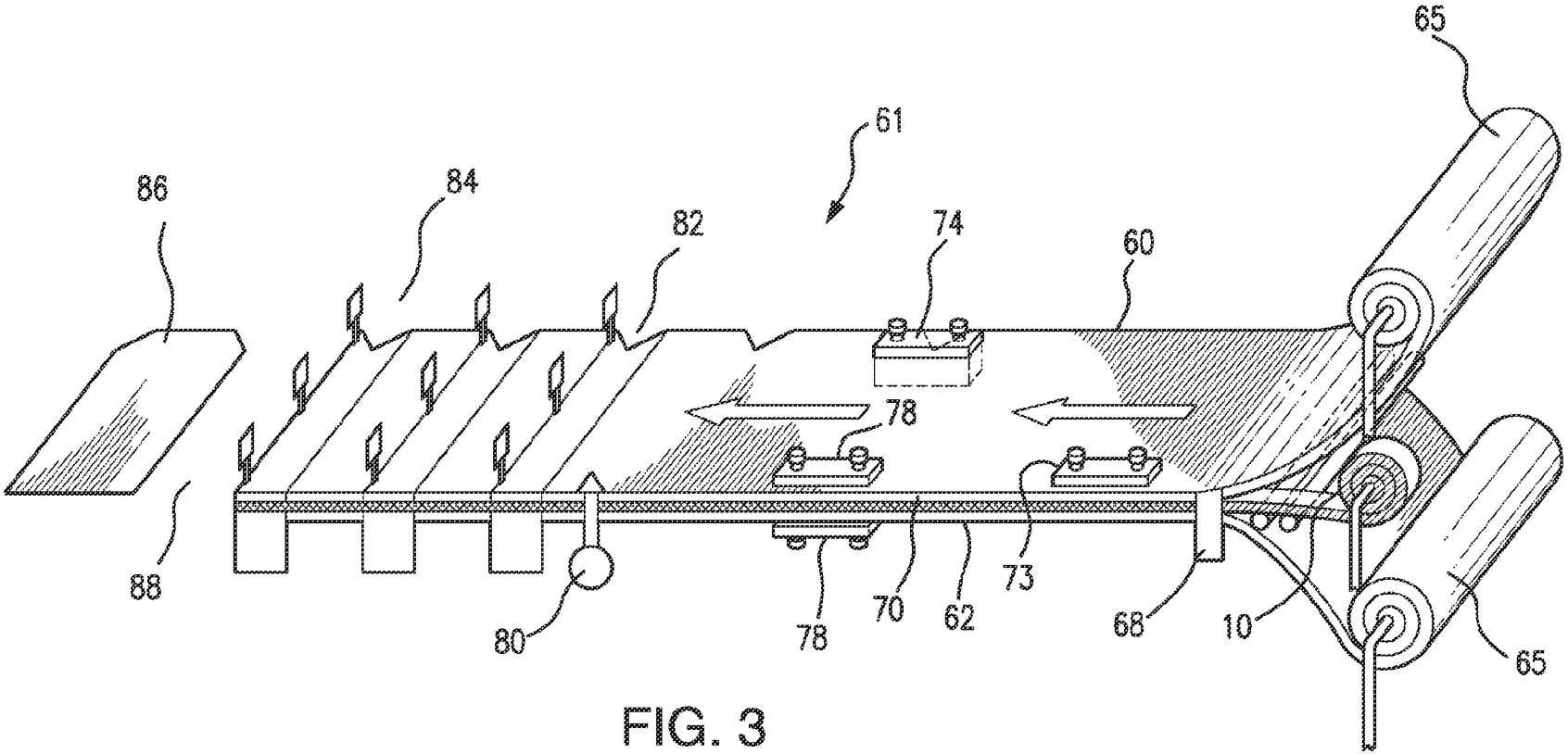
FIG. 3 is a schematic view of a portion of the process for making bags or pouches showing how the intermediate product of FIG. 1 is folded and then inserted between moving continuous webs or films adjacent one side of the webs or films; the webs or films thereafter being processed to result ultimately in bags or pouches.
Figure 3A:
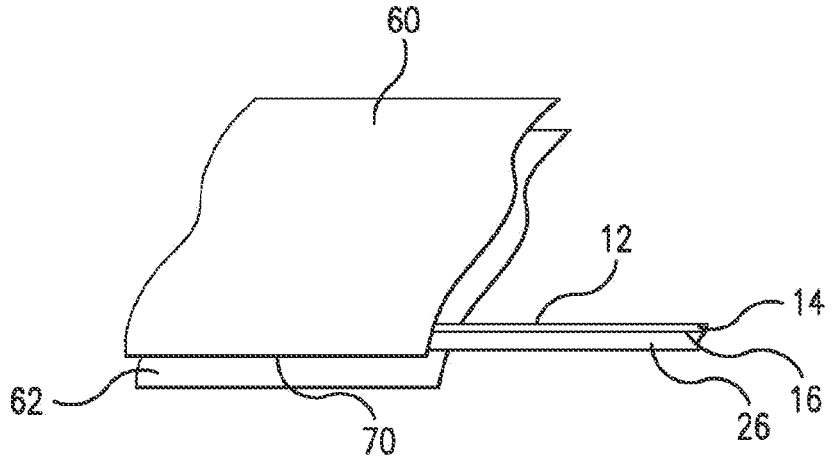
FIG. 3*a* is a schematic view of parallel running continuous webs or films, one on top of the other with the unique tape shown in FIG. 1 inserted between the webs along one of their edges.
Figure 3B:
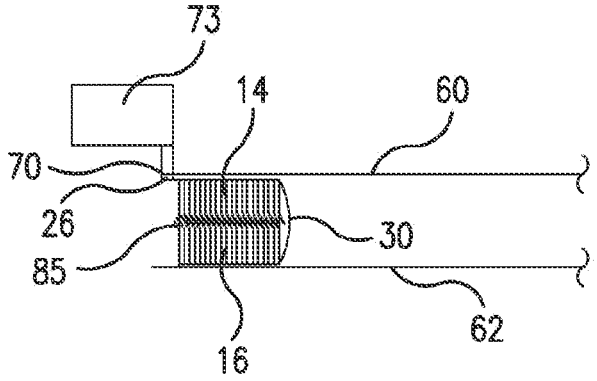
FIG. 3*b* is a sectional view showing the showing the folded tape first being sealed to the top web or film via the action of a pre-sealing unit.
Figure 3C:
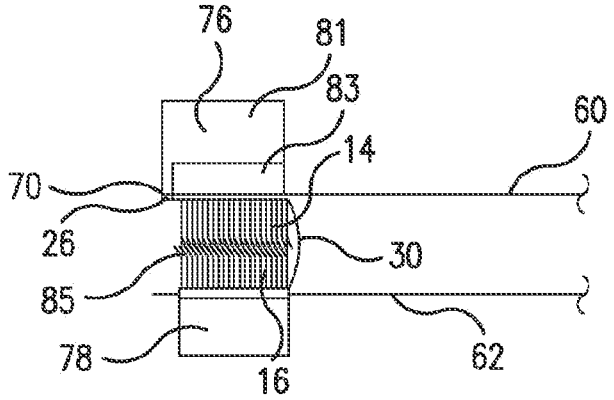
FIG. 3*c* is a sectional view schematically showing the folded tape sealed to the top web or film then being sealed to the bottom web or film via the action of a sealing unit.

Next, as shown in FIG. 3 the webs 60 and 62, having the tape 10 sealed to the top web and sealed to the bottom web, as described, advances to a slitter 80 whereupon the fastened top and bottom webs are opened and a slitting tool 80 is inserted to completely cut through the perforation line 30 to separate the two lanes 14 and 16. Finally the bags or pouches are processed to form a gusset as indicated at 82 along the opposite edges of sealed webs 60 and 62, if so desired, and this is done in a conventional known manner. Thereafter the webs 60 and 62 are cross sealed in a known conventional manner as indicated by 84 and finally, the individual bags or pouches 86 are obtained via a conventional and known cutoff device 88. All components are mounted on frame 61.

Figure 4A:
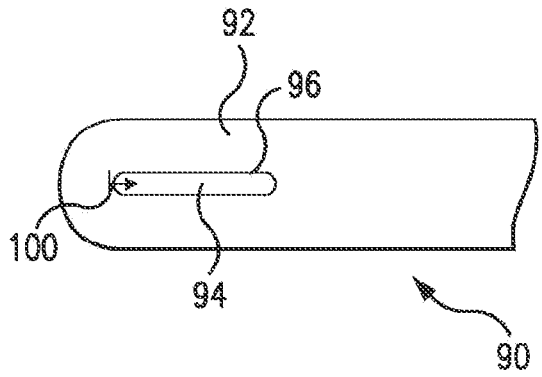
FIG. 4*a* is perspective view partly cut away of a folding tool for effecting folding of the intermediate product (tape of FIG. 1) prior to sealing to the webs or films.
Figure 4B:
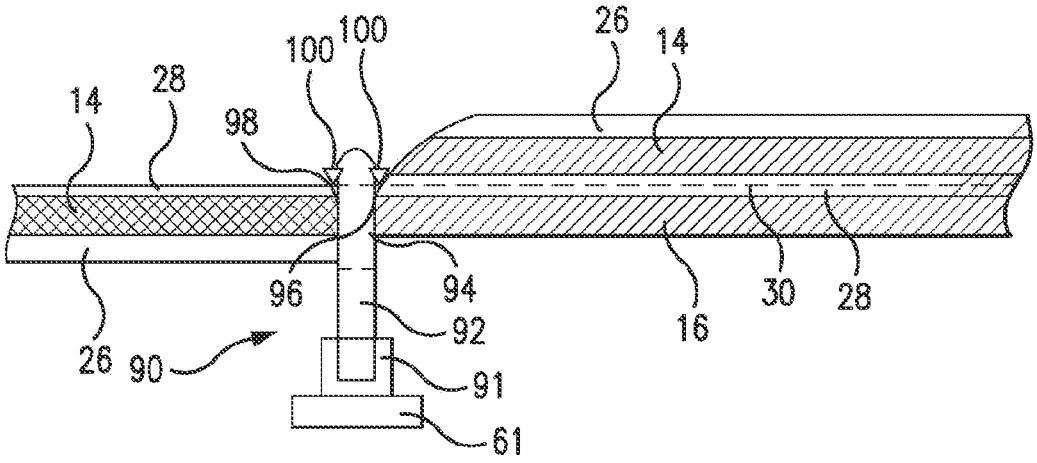
FIG. 4*b* is a top view of the novel tape being folded as it passes through the folding tool mounted for rectilinear adjustment showing the folding showing the folding schematically.

Referring now to FIGS. 4*a* and 4*b*, a novel tool 90 is shown for effecting the folding of the tape 10. This tool consists of an elongated rod or bar 92, mounted on frame 61 via any known conventional rectilinear adjustment 91 that can adjust tool 90 both vertically and horizontally. Tool 90 has an axial extending radial or transverse elongated through hole, orifice or opening 94 extending axially or longitudinally with respect to tool 90 and sized to accommodate the width of a fastener lane 14 or 16 and flange 26. The opening or orifice 94 is dimensioned radially or transversely to accommodate with minimal clearance the two fastener lanes 14 and 16 compressed or mated together when acting as a closure. Entry edge 96 and exit edge 98 of the orifice are rounded or chamfered. Whereas the opening or orifice can have a uniform cross section radially from entry side to exit side, as an alternative or modification, the cross section from entry to exit can gradually diminish or narrow radially. This enables the entry to be larger and accommodate the partially folded tape 10 with the lanes partially engaged at entry and the exit to be narrower to complete the folding and the lanes to be fully engaged and compressed together when the tape 10 exits. The tape 10 traverses the opening or orifice and exits fully mated or engaged.

In a further modification, one of the entry and exit sides of tool 90 has mounted thereon a knife edge 100 that partially protrudes into the path of a folding or folded fastener passing through the orifice for the purpose of intersecting the connecting web 28 between the lanes and cutting through the perforation line 30 of the folded or folding tape 10 to separate the two lanes 14 and 16. Although shown in FIG. 4*b* on both sides of tool 90, only one such slitter or knife edge 100 is required. The slitting can take place only after the fastening elements of the two fastener lanes 14 and 16 have sufficiently engaged so that thereafter any forces placed on the fastener lanes do not prevent or disturb their engagement, mating or registry when folded or after being folded. Although the folding commences upstream of the folder rod 92 and the fastening elements of the lanes 14 and 16 already have engaged at the time of passage into the entry of the orifice 94, nevertheless, a slitter 100 at the exit of the orifice may be preferred as at this point the fastener lanes 14 and 16 are fully engaged, mated and in registry. FIG. 4*b* shows a tape 10 passing through the orifice shown in FIG. 4*a*. As will be evident from FIG. 4*b*, the laid-open tape 10 is fed to the entry 96 of the orifice of rod 92. Emerging from the orifice, due to the folding action, the lanes 14 and 16 are in registry with lane 14 on top and flange 26 is protruding on one side and the substrate portion 28 is protruding on the other side, cut through at the perforation line 30 or not depending if a slitter is being used or not and on placement of the slitter 100. As noted previously, alternatively, a slitter tool 80 can be located downstream of the sealing of the tape 10 to the two travelling webs 60 and 62, see FIG. 3. The substrate 12 covers lane 14 but only flange 26 and substrate portion 28 is shown in FIG. 4*b* for simplicity.

Figure 5A:
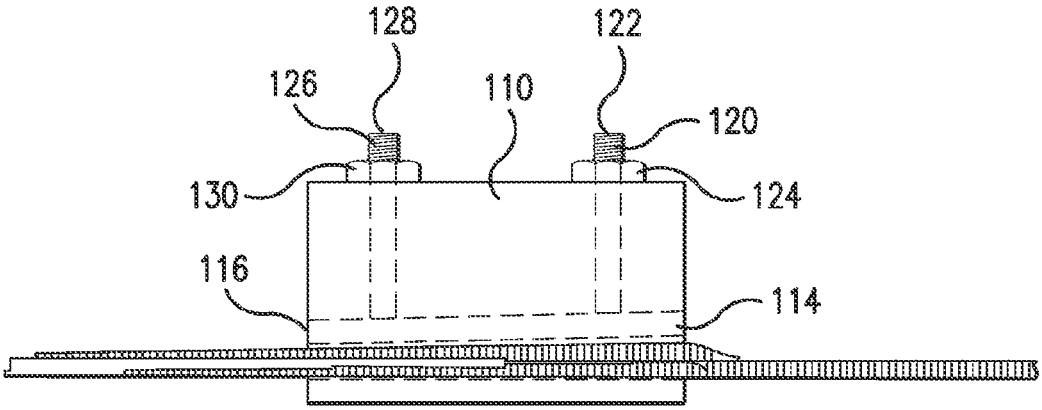
FIG. 5*a* is a side view showing another folding tool having adjustability and schematically showing the folding operation.
Figure 5B:
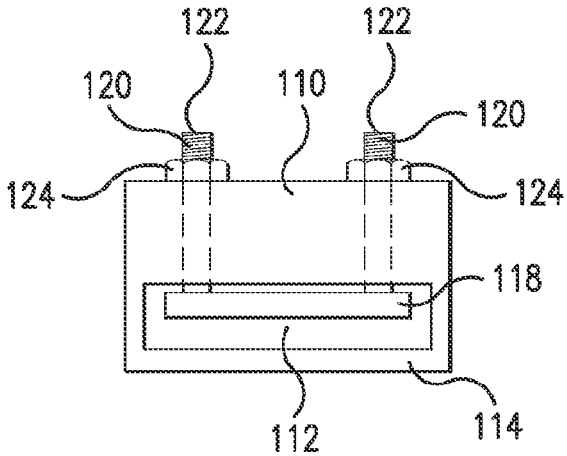
FIG. 5*b* is an end view of the folding tool shown in FIG. 5*a*.
Figure 5C:
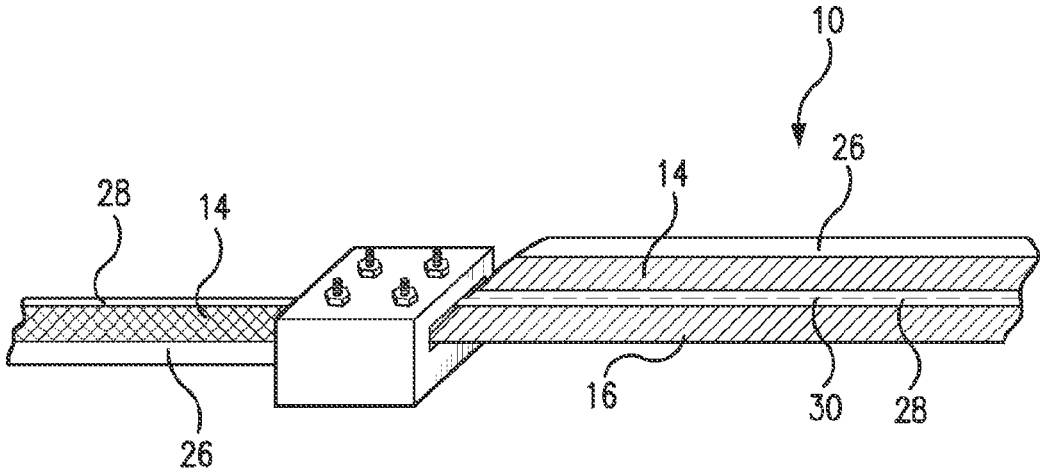
FIG. 5*c* is a perspective view of the folding tool shown in FIG. 5*a* schematically showing the folding operation.

A modified folder is shown in FIGS. 5*a*, 5*b* and 5*c*. As shown, the folder consists of a housing 110 having a hollow interior, an entry slot 114 and an exit slot 116. A plate 118 is mounted in the interior of housing 110 via a pair of bolts 120 fixed to the front of the plate 118 adjacent the entry slot 114. Bolts 120 pass through openings in housing 110 and protrude above the top of the housing 110. Bolts 120 are threaded on their free ends 122 onto which nuts 124 are threaded and can be rotated to adjust the vertical position of the plate 118 relative to the entry 114. A second pair of bolts 126 is fixed to the rear of plate 118 adjacent the exit slot 116. Bolts 126 pass through openings in housing 110 and protrude above the top of the housing 110. Bolts 126 are threaded on their free ends 128. Nuts 130 are threaded onto the bolts 126 and by rotating nuts 130 the vertical position of the plate 118 can be adjusted relative to the exit 116. As the folding of tape 10 takes place in housing 110, the tape entering the housing requiring more vertical space as the folding is only in process, whereas the folded tape 10 exiting housing 110 is more compressed in a vertical sense and requires less vertical space. Accordingly, the plate 118 is adjusted so that the front end adjacent to entry slot 114 is positioned higher in the housing interior 112 than the rear end of the plate 118 adjacent to the exit 116 of housing 110. This is evident as the plate 118 tilts from front to back as shown in FIG. 5*a*.

FIG. 5*c* shows tape 10 passing through the folder. Tape 10 is introduced to the folder in a laid out flat condition as shown in FIG. 1. As previously explained the tape 10 is initially folded over manually about the perforated line 30 and threaded through the entry slot 114 and pulled out the exit slot 116 to initiate the folding operation. This produces a curling of the tape 10 as it approaches the entry slot 114 initiating a folding action. Then the folding operation will take place automatically as the folded tape 10 is pulled from the exit slot 116 of the folder as the tape upstream of the entry slot 114 is curling and being folded just prior to its entry into the housing. As noted above, except for flange 26 and substrate portion 28, the rest of the substrate on the downstream side of the folder is not shown for clarity, so what is shown in FIG. 5*c* is the back of lane 14 covering lane 16 and the back of the flange and substrate portion 28.

Figure 6:
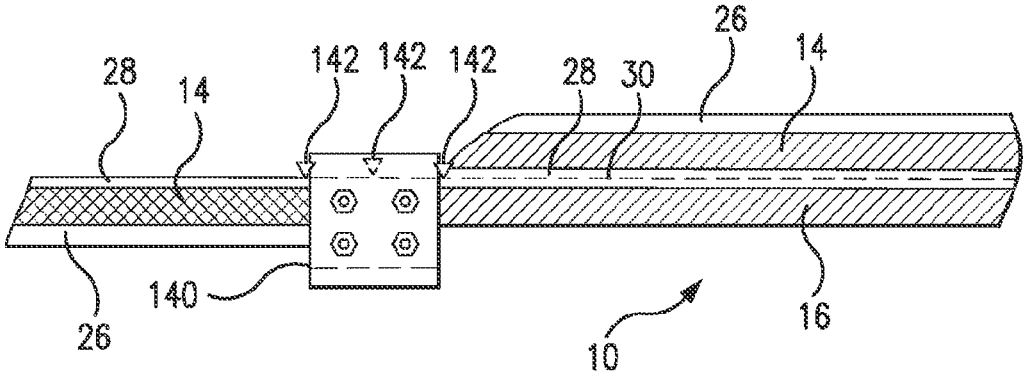
FIG. 6 is a schematic view of the folding operation in conjunction with a slitter for performing a slitting operation with optional locations for the slitting tool shown.

FIG. 6 is a further schematic showing of the folding operation to prepare the tape 10 for sealing in a plastic bag or pouch. As shown, a folder 140, like the folder described in conjunction with FIG. 5*a-c*, is fed with a laid out tape 10 as described in conjunction with FIG. 5*c*. The folder 140 has mounted thereon a knife edge or slitter 142 at one of the entry slot or exit slot of the folder or inside of the housing intermediate the entry and exit. Although a slitter 142 is shown at three possible locations in FIG. 6, only one is required.

Figure 7:
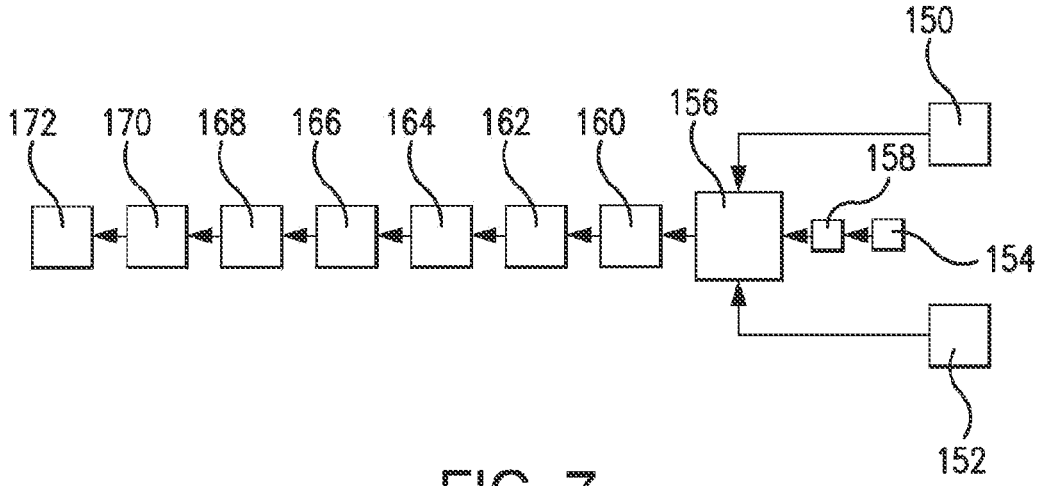
FIG. 7 is a block diagram illustrating the improvements to a pouch making machine essential to carry out the present invention.

FIG. 7 shows in block diagram the essential components of a machine for making bags or pouches according to the present invention. The machine consists of a frame to mount and support all the machine components. Mounted on the frame are supply rolls 150 and 152 for feeding webs of plastic film used to make the bags or pouches, and a supply roll 154 for feeding the tape 10 in a laid out form. The plastic webs are fed to a station 156 where they are running one over the other with the folded tape 10 running between them. The tape 10 is fed to a folder 158 which serves as a restriction point, as described herein, and then to the station 156 for attachment to the webs. The webs and folded tape 10, correctly adjusted and juxtaposed, are fed to a first sealing station 160 including a presealing and slit sealing unit operating with constant motion for sealing the flange of the folded tape 10 to the top web adjacent one edge, as described herein, to lock the closure tape 10 in position relative to the webs. The webs and folded tape 10 are then fed to station 162 including a top and bottom sealing unit where the flange is fully sealed to the tap web while a chiller is applied to the area corresponding to the lane 14 to prevent it being sealed to the top web while lane 16 of the folded tape is sealed to the bottom web adjacent to the corresponding edge. Also, the opposite edges of the webs are sealed by a known unit to form the bottom of the bags or pouches being made. The webs are fed to a slitting station 164 for perforation separation where the closure of the webs is opened, a slitting tool inserted and the perforation line 30 of tape 10 is cut through and separated completely so that lanes 14 and 16 of tape 10 are separated. Next the webs advance optionally to a gusseting station 166 where a gusset is formed in the portion of the webs that will be bag or pouch bottoms. The webs are then passed to a cross sealing station 168 where the sides of the bags or pouches are sealed, and then to a cut-off station 170 where the bags or pouches are individuated, and finally to a product collection station 172. As noted all components are mounted preferably on a common machine frame. The cutting of the perforation line 30 results in the closure being sealed to each side of the mouth of the bags or pouched produced and to enable the bags or pouches to be opened by pulling apart the lanes 14 and 16 forming the fastener, whereupon material or product can be poured in or otherwise filled into the bag of pouch and then the closure can be closed by pressing the two lanes 14 and 16 together. The drives of the machine and the necessary roller arrangements have been omitted for simplicity and are well known and understood by persons of ordinary skill in the art.

Figure 8:
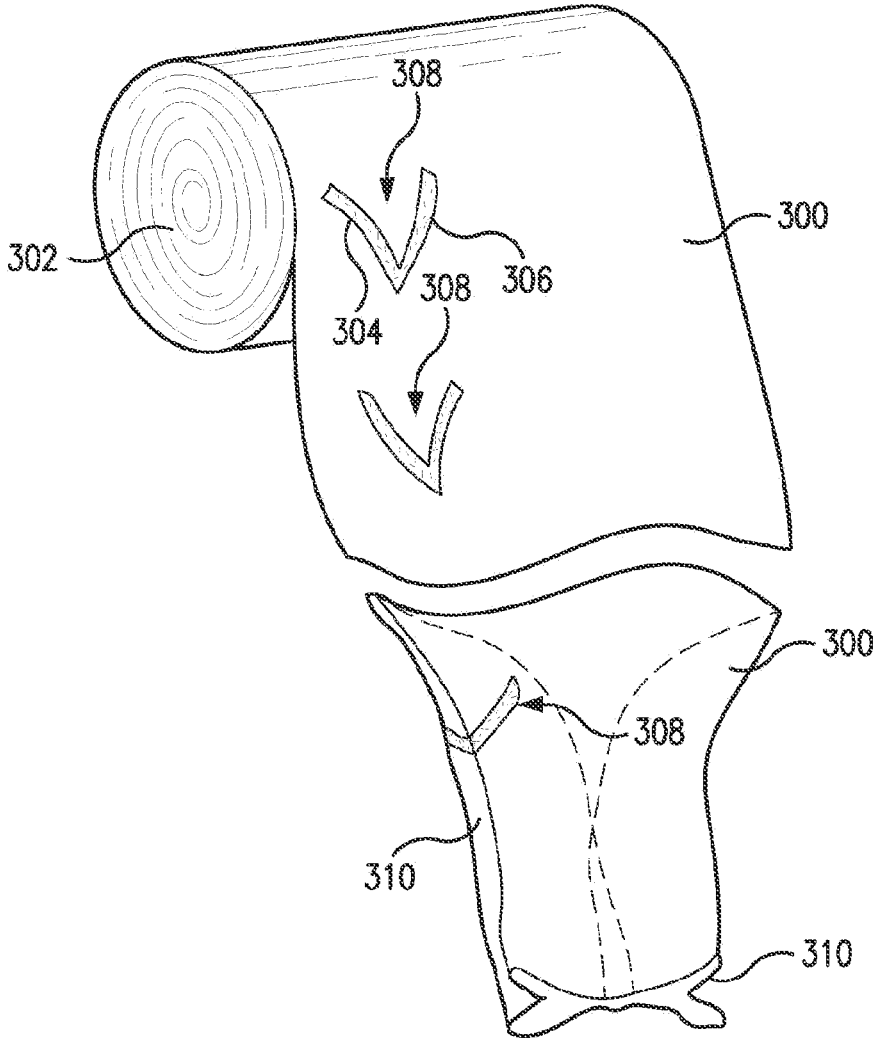
FIG. 8 is a schematic representation of a film passing through a bag making machine showing the placement on the web of film of fasteners each comprised of dual fastener strips placed in dual directions to form a V-shape relative to the web or film travel and the subsequent folding of the web or film to form gussets in opposite sides of the web or film.

Referring now to FIGS. 8 to 12, the novel diagonal closure or fastener, and the application procedure for pouch forming will be described. In FIG. 8, the substrate material 300, web or film of plastic is presented in a flat form in a bag making machine from an unwind roll 302. A universal applicator can apply a fastener or closure 308 at variable angles (if needed) for diagonal application or compound diagonal V-shaped application. The fastener can be composed of two strips 304 and 306. A particularly novel application uses a Velcro® Hook-to-Hook closure or any other fastener that can grip to itself and create a closure in a diagonal or compound shape, such as V-shaped on the film or gusset area. The closure 308 is applied to an area on the substrate 300 then heat sealed on the film (substrate) in the flat gusset area or any area prior to folding into a side gusset bag, flat bag, pillow bag or any type of bag or pouch. The area on the film to which the closure 308 is applied may vary based on the operation or function of the bag or pouch being formed. The gusset 310 will open like a pour spout and recluse into a four layer gusset, or with any type of pouch the two layers will act to pour and recluse with a diagonal pour. The closure 308 can be heat sealed to the substrate using two strips 304 and 306 as shall be described hereinafter.

The film with the Velcro® closure or fastener applied will go through the folding section of the machine (gusset formation) and create the face, back, sides or the gusset(s) for the bag. It is preferred to use a soft folding technique known in the art that will allow the material to fold through without damaging the fastener or closure 308. To this end, the folding section uses adjustable plates that will move in an out to create larger or smaller gussets in order to maintain the size of the pouch and gussets as desired. Adjusting handwheels on the outside of the machine provides for this easy adjustment. Rolling wheels are used prior to the insertion of internal forming plates that will relieve the tension of the film and allow a natural folding of the material and forming of the bag. In the preferred method the soft fold (prefold) half of the gusset is formed first through two large rolling wheels that relieve the tension on the outside of the material, and guide over two internal adjustable forming plates to create the back of the pouch or bag. The material is then guided over two internal adjustable plates so the material hanging over the plates can relax and be slightly tucked into position for the gusset by two more external adjustable plates. This completes the perform of the gussets. The material is then brought upwards to a smoothing dimpled roller to remove air and flatten out the material. The material is then reversed and allows for the secondary folding to be presented upwards. This action also sets the final position of the gussets or folds by soft creasing as the material travels through an "S" Wrap of idler rollers. Additional rolling/angled wheels will aid in the final folding of the material into the layout of the pouch. The process of forming a single or dual gusset on the machine is done preferably in two steps not one. The web with single folded gussets is introduced into a series of complete forming wheels and then directed under a guide plate sized accordingly to the width of the pouch. This enables angled rollers to complete the soft folding of the gussets and put in the final fold. This action is done in a constant motion section of the machine. The film will enter into the sealing section of the machine to seal the side into the final shape of the pouch (bag).

Figure 11A:
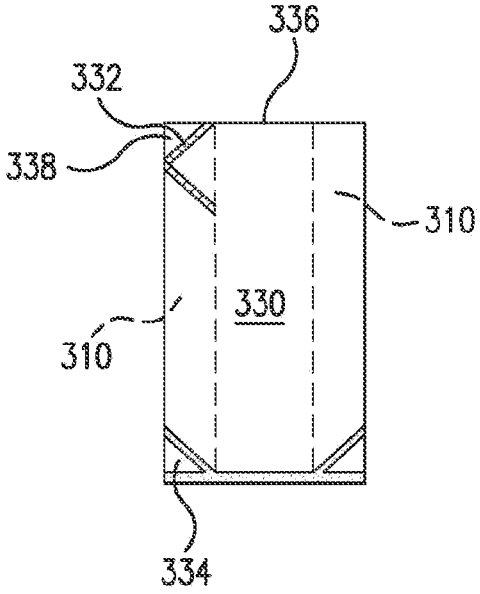
FIGS. 11A-D show schematically a plastic bag having the novel dual fastener strips in dual directions to form a V-shaped fastener or closure of FIG. 8 in a gusset on at least one side that may or may not extend partially about the bag opening.
Figure 11B:
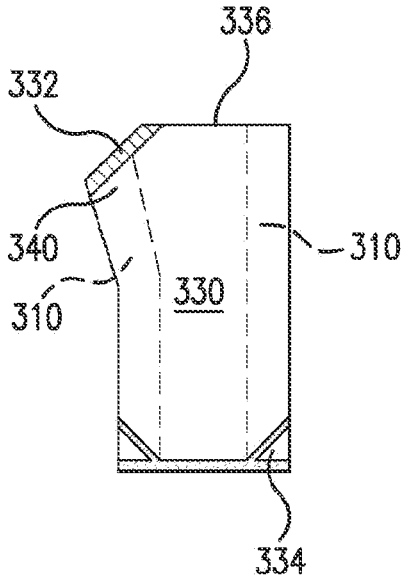
Figure 11C:
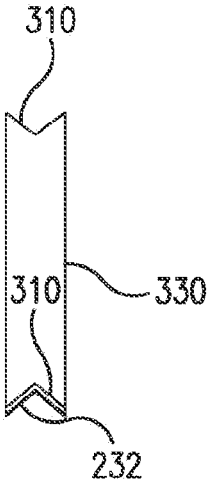
Figure 11D:
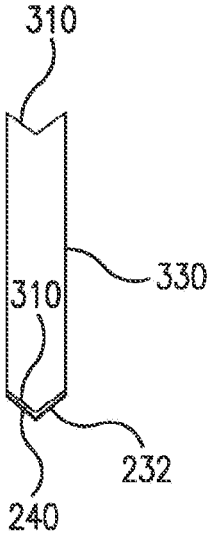

The premade pouch then can be filled and sealed closed by the end user or the filling company with product, and then, the customer will cut off (or tear off) the triangular area above the diagonally placed fastener in order to open the pour spout and use product. Once the product is used then the customer no longer needs to refold the gusset back to close, but may interlock the fastener while the pour spout is extended in a natural diagonal closure for the pouch. In this respect, see FIGS. 11A to D which shows in FIG. 11A a bag 330 with a block bottom 334 having a novel diagonal closure 332 with the bag gusset 310 tucked in on itself with the fastener or closure 332 sealed in a V-shaped pattern and the bag top 336 open and ready for filling. In FIG. 11B is shown the bag 330 sealed at the top 336 and with the triangular corner 338 cut off or torn off and the gusset 310 pulled out (reversed) to form a pour spout 340 and the closure 332 opened for pouring. This occurs after filling and sealing by the customer after purchase. FIG. 11C shows the closed (reversed) gusset 310 and FIG. 11D shows the opened gusset 310 to form the pour spout 340.

A particularly advantageous structure for the closure or fastener is a novel hook-to-hook Velcro® closure on a preselected percentage of the top opening of the bag or pouch.

The design can be used with full Velcro® closure to encapsulate all the distance around the interior of the bag top or limited to the area needed to pour. A unique advantage of the invention is that the gusset can be closed onto its four layers and the bag will maintain its original shape or one can pour from the pouch by reversing the gusset, pulling it out, to two layers, and then close the gusset together and seal the pouch. The area on the film may vary based on the operation of the bag or pouch. Some may want just the gusset to open like a pour spout up to full web width, giving the reversible gusset closing feature on both sides of pouch. Others may want the inventive closure on one side only. Thus the invention contemplates a closure for a bag or pouch having an opening with a hook to hook Velcro® strip extending at least partially around the bag or pouch opening. The hook to hook Velcro strip can extend completely around the bag or pouch opening. The bag or pouch can have a gusset and the hook to hook Velcro® strip can extending at least partially around the bag or pouch opening and include the gusset. The bag or pouch can have a gusset on both sides and the hook to hook Velcro® strip can extend around the bag or pouch opening over the gussets.

The basic method of the invention for making a bag or pouch having a closure comprises the steps of applying hook to hook Velcro strips to preselected areas of a web to be processed into bags or pouches at locations on the web corresponding to the location of the bag or pouch closures, and processing the web to produce a plurality of bags or pouches each having an opening with a hook to hook Velcro strip extending at least partially around the inside of the bag or pouch opening. The method has particular application for the produced bags or pouches each having at least one gusset, and the associated hook to hook Velcro® strip extends over the gusset of each produced bag or pouch in a diagonal and dual direction.

Figure 10:
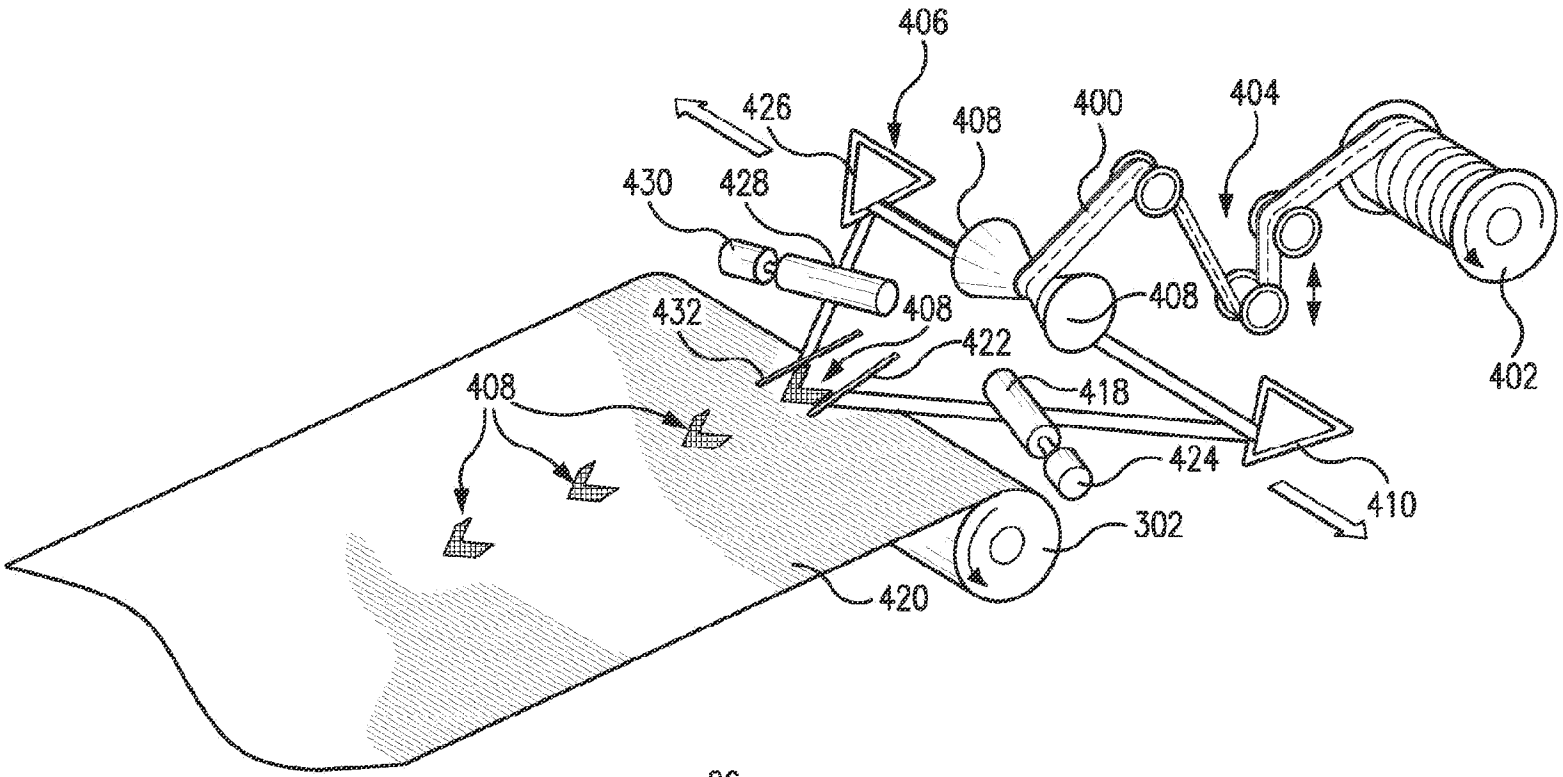
FIG. 10 is a schematic representation of the method for placing the dual fastener strips in dual directions to form V-shaped fasteners, as shown in FIG. 8, relative to the web or film travel.

Referring now to FIGS. 10 and 11, a method for applying the diagonal and dual direction closure 308 to a web 420 being processed in a bag making machine will be described. As shown, a tape or strip 400 as shown and described in conjunction with FIG. 1 is fed from a source or roll 402 via rollers 404 to an applicator, generally referenced as 406. As previously described, the tape 400 consists of the novel intermediate product schematically shown in plan in FIG. 1. The product 400 is an endless tape, or strip or ribbon that can be wound on a bobbin or roll for convenience. The tape 10 is composed of a substrate or base film 12 of a polyolefin or blend of polyolefin. However, any heat sealable material can be used. Base film or substrate 12 is from about 1 mil to about 8 mils thick, with 5 mils being preferred. Sealed onto base film 12 by any known means are two lanes 14 and 16 that will coact together and mate to engage and form a fastener. Suitable materials for this purpose would be commercial strips sold by Velcro USA Inc. under the trademark Velcro®. A typical example is one lane been of a hook construction and the other lane being of a loop construction, as well known in the art, so that when pressed together they form a fastener/closure that can be opened by pulling apart. In FIG. 1, the two lanes 14 and 16 are comprised of Velcro® bidirectional hook lanes as the preferred choice. The lanes 14 and 16 extend parallel and are from about ¼" to about 1 wide, with ⅜" being preferred and are spaced apart by web portion 28 of film 12 having a width of from about ⅛" to about ½", with ¼" being is preferred. The space or substrate portion 28 between the two lanes 14 and 16 constitutes a fold area and is comprised of that portion of film lying between the two lanes. As will be apparent from FIG. 1, lane 16 is co-terminal with edge 13 of film 12 on its side 20 remote from lane 14. Lane 14 on its side 22 remote from lane 16 terminates spaced from edge 24 of film or substrate 12. The substrate or space portion from lane 14 to edge 24 is comprised of base film 12 and constitutes a flange 26 that is from about ⅕" wide to about 1" wide, with ¼" wide being preferred. The dimensions noted above are for commercially make plastic bags or pouches most frequently being made presently. The invention is not restricted to the above dimensions and would be revised according to the size of bag or pouch being made.

Whereas any form of such type of Velcro® fastener can be used, including hook-loop, hook-hook, and other designs sold by Velcro USA Inc., the hook-to-hook is preferred and deemed the best arrangement. Also, similar fasteners made by others can be used, such as a known mushroom head style, or an arrowhead style as conceived by the inventor hereof. What is important is that the closure be comprised of two parts that coact, engage releasably and mate when pressed together (compressed) to close and seal an opening, but can be subjected to a preselected tension force to uncouple and re-open and unseal the opening in the pouch for either material to be removed from the pouch or bag or material to be filled into the bag of pouch or bag.

The substrate portion or space 28 between the two lanes 14 and 16 defines a perforation line 30 exactly midway between the two lanes. Perforation line 30 consists of a series of lands interspaced between through cuts. The perforation line 30 ranges from about 50% cut/50% and to about 90% cut/10% land, with about 70% cut/30% land being preferred. The perforation line enables easy and effective separation of the lanes 14 and 16 during the procedure for making bags or pouches yet enable the lanes to register exactly and are either be fully engaged or mated. Perforation line 30 constitutes the separation line into two separate strips. By means of the perforation line 30 as described the making of bags or pouches proceeds in an exceedingly easy and effective way.

The tape 400*s* received on freely rotating tapered rollers 408 where the two portions of the tape 400, namely, strip 16 and strip 14 with flange 26 attached, are separated along the easily separating perforation line 30. Strip 16 is turned 90 degrees and passes to a turning bar 410 where it is redirected in an acute angle toward the travelling web of film 412 with a gusset area 414 defined by dotted lines 414*a* and 414*b* having a centerline 416. Strip 16 is driven by drive rollers 418 driven by motor 424 at an acute angle to the centerline 416 of the travelling web or film to a cutter 422 that cuts strip 16 after it has passed a predetermined and preselected distance or length. The cutoff strip 16*a* is heat sealed to the web or film at centerline 416 at the driven acute angle to the longitudinal direction of travel of the web or film 420. The acute angle is preferably 45 degrees, but can vary from about 10 to about 80 degrees relative to the line on web 420 about which it is centered. Similarly, the separated strip 14 with flange 26 attached is turned 90 degrees in the opposite direction and passes to a turning bar 426 where it is redirected in an acute angle toward the travelling web of film 412 with gusset area 414 defined by dotted lines 414*a* and 414*b* having a centerline 416. Strip 14 is driven by drive rollers 428 driven by motor 430 at an acute angle to the centerline 416 of the travelling web or film to a cutter 432 that cuts strip 14 after it has passed a predetermined and preselected distance or length. The cutoff strip 14*a* including the flange 26*a* is heat sealed to the web or film at centerline 416 at the driven acute angle to the longitudinal direction of travel of the web or film 420. The acute angle is preferably 45 degrees, but can vary from about 10 to about 80 degrees. The flange 26*a* of the cutoff strip lies toward the top of the finished bag to act as a hinge for the unsealed strip 14*a*, see FIG. 12A.

Figure 9:
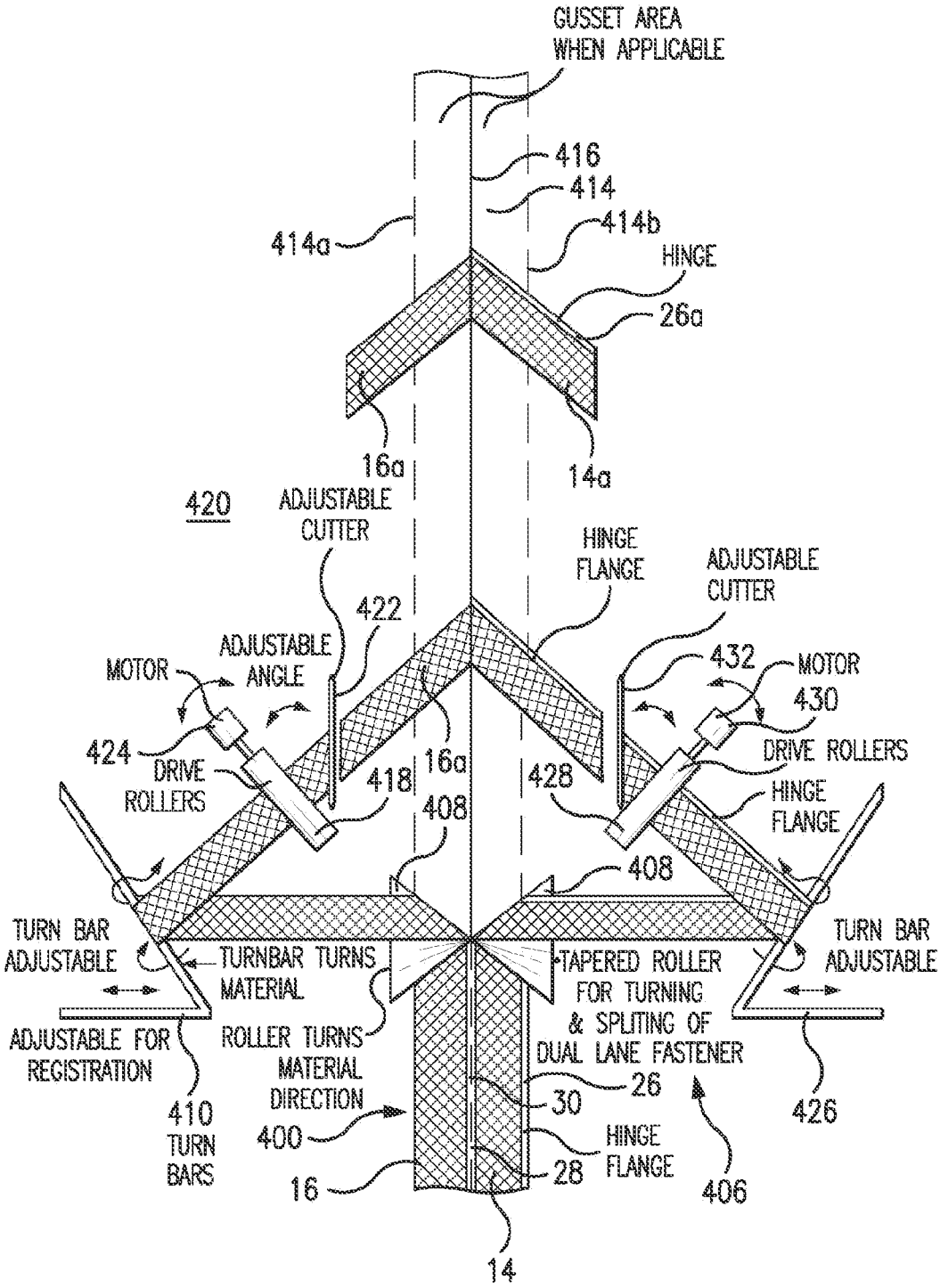
FIG. 9 is a schematic representation of apparatus that serves to apply the dual fastener strips placed in dual directions to form the V-shaped fasteners, as shown in FIG. 8, relative to the web or film travel.

As indicated by arrows on FIG. 9, the turn bars 410 and 426 are adjustable transversely relative to the travelling web or film 420 both linearly and angularly. The drive rollers and motor are also adjustable linearly and angularly to match the turn bars and drive the strips 14 and 16 without stress. Also, operation of motors 424 and 430, which can be step motors, are controlled by known means with reference to strips 14 and 16 to insure that the cutoff strips 14*a* and 16*a* are heat sealed to the web or film 420 registered appropriately; this may also involve a known monitoring device like a COD or photoelectric eye to determine the relative positions of the rows of hooks on the strips to insure that the strips are appropriately staggered for correct registration. The V-shape can vary from an acute angle of 10 degrees to 80 degrees relative to the gusset centerline or a longitudinal line on the web or film 300 about which it is positioned. The preferred angle is 45 degrees.

Figure 12B:
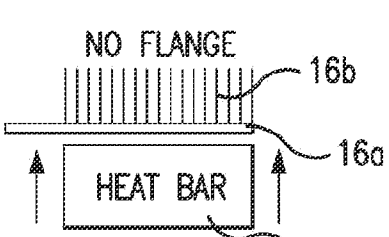
FIGS. 12A and 12B show respectively and schematically the two strips of the closure that are placed diagonally in two directions on the web or film to form the V-shaped closure of FIG. 8.
Figure 12A:
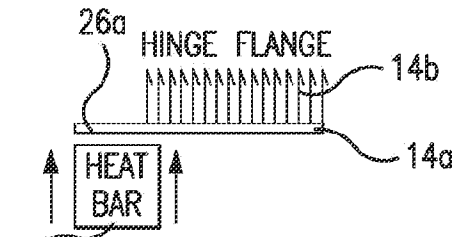

The heat sealing of the cut strips 14*a* and 16*a* is as follows. Strip 16*a* is sealed completely to the web 420 whereas the strip 14*a* and flange 26*a* is sealed to the web 420 only by the flange 26 with the strip 14*a* being free. This is shown in FIGS. 12A and 128. In FIG. 12A, the strip 14*a* having hooks 14*b* and attached flange 26*a* is sealed by a heat bar 440 that underlies only the flange portion 26*a*. In FIG. 128, the strip 16*a* having hooks 16*b* is sealed by a heat bar 442 that underlies the entire strip 16*a*.

As seen in FIG. 10, the diagonal and dual direction fasteners or closures are heat sealed to the travelling web or film 420 as it advances longitudinally. In this juxtaposition, the bags to be made are with the bottom of the bags leading and the top of the bags trailing.

The closures are spaced according to the bag length. Alternatively, it is possible to make bags that have a plurality of closures spaced from top to bottom of bags on one or both sides that are compartmented top to bottom and also side to side so that multiple materials or individual portions of a material can be loaded into the bags and each heat sealed section provided with its own pour spout.

Also, it is possible that the closures described can be formed first on a narrow substrate (web or film) using either the tape or separate fastener lanes by using the described method so that the closures can be preformed and the narrow substrate cut at intervals to cut off the preformed closures one-by-one and heat sealed to a film of a bag making machine in the gusset area. This would eliminate the registration issue and enable the alignment with the centerline of the gusset easier.

Figure 13:
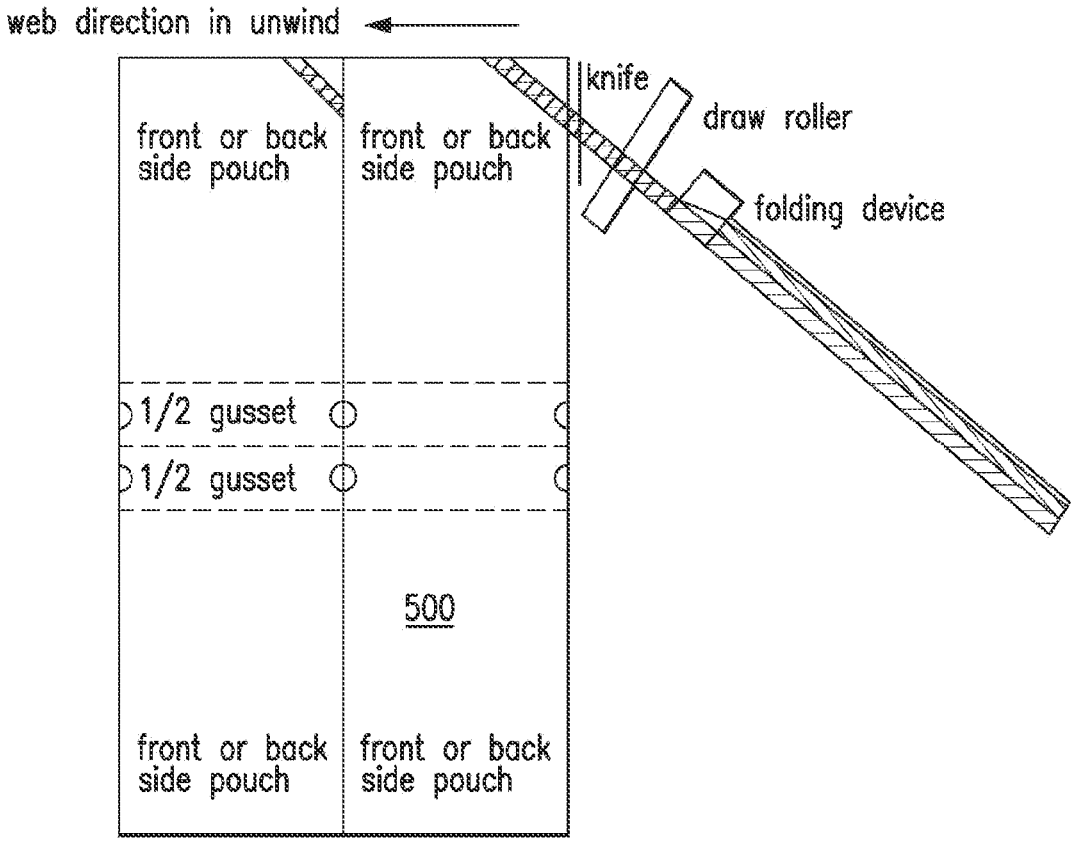
FIG. 13 is a schematic drawing of a moving web onto which a diagonal fastener is placed prior to forming of bags.

FIG. 13 shows the placement of a diagonal fastener on a moving web 500 prior to formation of stand-up plastic bags. As shown, the plastic film or web 500 is being unwound from a roll of plastic film and is travelling in the direction in unwind as indicated by the arrow at the top of the figure. The bags to be formed from the web 500 will consist of opposed lateral panels 502 and 504 on opposite lateral sides of the web 500 to form the front side and back side of the bag, as indicated by the legend on the drawing; two such bags are shown. The lines on the drawing are notional and only for illustration purposes. In the middle section of the web 500 are side by side ½ gussets, see legend on the drawing, to form the bag bottom. A tape 10 as shown and described with reference to FIG. 1 is fed to a folding device, as shown and described with reference to FIGS. 4*a* and 4*b*, and tape 10 is folded upon itself. A draw roller or pair of draw rollers controlled by a motor provided with the usual electrical controls feeds the folded over tape 10 toward the web 500. A cutter cuts lengths of the folded over tape 10 to fit diagonally across one side of web 500 at what will be a corner of the finished bag and the side of the folded over tape contacting the web 500 is sealed onto the web 500. The leading bag in FIG. 13 already has a diagonal length of folded over tape sealed to the web 500 and the trailing bag is in the process of having a length of folded over tape cut off and to be sealed to the web 500.

Essentially what is being done is that the Velcro® tape 10 of FIG. 1 is being fed through the folder devise shown in FIGS. 4*a* and 4*b* to fold the lanes one over the other. Then the folded over tape is fed directly to web 500 or first passes through a diagonal applicator as shown in FIG. 9, with the difference that only one direction (not dual directions) is required. This enables application of the folded fastener in one diagonal direction to one side of the film or web 500. Thus, the Velcro® folded over tape 10 is being placed on the diagonal with the lanes mated together and then sealed on one side only (presealed).

Afterwards as the web advances through the bag making machine, the advancing material is processed to create a 3 sided sealed bag or a standup pouch with a diagonal closure sealed on both sides at the top of the pouch. The processing of the web 500 incorporates the creation of a diagonal closure, which is particularly advantageous if one desires a diagonal fastener at the top corner of a standup pouch. It is known to have a diagonal closure sealed into an already created bag or pouch. In the prior art it is known to insert an already mated zipper into an already formed pouch then sealing in a final seal station area. In the present invention, the diagonal seal is initially applied to the web 500 in the unwind portion of our machine, then finally sealed in an integrated way during forming of the web into a pouch with diagonal seal in an upper corner; the processing is more integrated and more efficient.

Although the invention has been described in terms of specific embodiments to enable persons of ordinary skill in the art to make and use the invention, nevertheless changes, modifications and further embodiments will be evident to such persons which do not depart from the teachings herein. Such are deemed to be included in the scope of the invention as set forth in the appended claims.

What is claimed is:

1. A method of making a plastic bag or pouch having at least one gusset comprising the steps of:

a. moving a plastic web in a longitudinal direction;

b. feeding a tape comprised of an elongated plastic film having a top surface and a bottom surface, a pair of elongated attachment lanes sealed to the top surface of said film, said lanes composed of complementary fastening elements to effect an attachable-detachable closure, said lanes extending parallel and being spaced apart, a single perforation line formed in said film midway between said lanes, and defining a flange defined on one side of only one of said lanes;

c. separating the lanes along the single perforation line;

d. cutting pairs of lengths off said separated lanes;

e. sealing each pair of said cut off lengths on a diagonal to the moving web in a region preselected for the at least one gusset and in different directions to form V-shaped closures with the lane having the flange on one side thereof sealed to the web by the flange only; and f. forming bags from the moving web wherein the attachable-detachable closure is located inside of the bag in the region of the at least one gusset.

2. The method according to claim 1 wherein said V-shaped closure is centered in said gusset.

3. The method according to claim 1 wherein the V-shaped closure is placed at the top of each bag formed.

4. The method according to claim 1 wherein the perforation line has from about 50% lands and about 50% cut through to about 10% lands and about 90% cut through.

5. The method according to claim 1 wherein the attachment lanes are from about ¼ to about 1" wide, from about ⅛ to about % "apart and the flange from about ⅕ to about 1" wide.

6. The method according to claim 1 wherein step (e) forms the V-shaped closures having an acute angle from about 10 degrees to about 80 degrees relative to the longitudinal direction of web movement.

7. The method according to claim 6 wherein step (e) forms the V-shaped closures having an acute angle of about 45 degrees.

8. Method of making a plastic bag or pouch having at least one gusset according to claim 1 further including the step of sealing the webs transversely so that bags are formed as compartmented bags wherein each formed compartment of the bag has a V-shaped closure located inside of the bag in the region of the at least one gusset.

9. Apparatus for making a plastic bag or pouch having at least one gusset comprising:

a. first drive rollers for moving a plastic web in a longitudinal direction;

b. second drive rollers for feeding a tape comprised of an elongated plastic film having a top surface and a bottom surface, and a pair of elongated attachment lanes sealed to the top surface of said film, said lanes composed of complementary fastening elements to effect an attachable-detachable closure, said lanes extending parallel and being spaced apart, a single perforation line formed in said film midway between said lanes, and said film on the top surface defining a flange on one side of only one of said lanes;

c. a separator for separating the lanes along the single perforation line;

d. a cutter mechanism for cutting pairs of lengths off said separated lanes;

e. a sealer mechanism for sealing each said pair of cut off lengths on the plastic web in a region preselected for at least one gusset and in different diagonal directions relative to the longitudinal direction of the moving web to form a V-shaped closure with the lane having the flange on one side thereof sealed to the web by the flange only; and f. a bag forming mechanism for forming bags having at least one gusset from the moving web, wherein the attachable-detachable closure is located inside of the bag in the region of the at least one gusset.

10. Apparatus according to claim 9 further including a centering device for positioning said V-shaped closurecentrally in said region preselected for at least one gusset.

11. Apparatus according to claim 10 wherein the bag forming mechanism is operative for placing the V-shaped closure at the top of each bag formed.

12. Apparatus according to claim 9 wherein the perforation line has from about 50% lands and about 50% cut through to about 10% lands and about 90% cut through.

13. Apparatus according to claim 9 wherein the attachment lanes are from about ¼ to about 1" wide, from about ⅛ to about ½" apart and the flange from about ⅕ to about 1" wide.

14. Apparatus according to claim 9 wherein the sealer mechanism is operative for positioning the cut off lengths relative to the longitudinal direction of web movement to define the V-shaped closures having, from about 10 degrees to about 80 degrees divergence.

15. Apparatus according to claim 14 wherein the V-shaped closures have a divergence of 45 degrees.

16. Apparatus for making a plastic bag or pouch having at least one gusset according to claim 9 further including a second sealer for sealing the webs transversely so that the bag forming mechanism forms compartmented bags wherein each formed compartment of the bag has a V-shaped closure located inside of the bag in the region of the at least one gusset.

* * * * *